US010273956B2

(12) United States Patent
Firzlaff et al.

(10) Patent No.: US 10,273,956 B2
(45) Date of Patent: Apr. 30, 2019

(54) VANE PUMP

(71) Applicant: ZF Friedrichshafen AG, Friedrichshafen (DE)

(72) Inventors: Uwe Firzlaff, Uhldingen (DE); Christian Michel, Ravensburg (DE); Florian Pöhnlein, Weildorf (DE); Stefan Csajagi, Eriskirch (DE)

(73) Assignee: ZF FRIEDRICHSHAFEN AG, Friedrichshafen (DE)

( * ) Notice: Subject to any disclaimer, the term of this patent is extended or adjusted under 35 U.S.C. 154(b) by 0 days.

(21) Appl. No.: 15/427,759

(22) Filed: Feb. 8, 2017

(65) Prior Publication Data

US 2017/0227004 A1 Aug. 10, 2017

(30) Foreign Application Priority Data

Feb. 9, 2016 (DE) ..... 10 2016 201 925

(51) Int. Cl.

| | |
|---|---|
| ***F03C 2/00*** | (2006.01) |
| ***F04C 18/00*** | (2006.01) |
| ***F04C 2/00*** | (2006.01) |
| ***F04C 2/344*** | (2006.01) |
| ***F04C 15/00*** | (2006.01) |
| ***F04C 15/06*** | (2006.01) |

(52) U.S. Cl.

CPC ..... *F04C 2/344* (2013.01); *F04C 15/0023* (2013.01); *F04C 15/06* (2013.01); *F04C 2240/30* (2013.01)

(58) Field of Classification Search

CPC .... F04C 2/344; F04C 2/3446; F04C 2240/30; F04C 15/0023; F04C 15/06

USPC ..... 418/131, 133, 259, 266–268

See application file for complete search history.

(56) References Cited

U.S. PATENT DOCUMENTS

| | | | | |
|---|---|---|---|---|
| 4,457,679 | A * | 7/1984 | Warnecke | B60T 17/02 418/268 |
| 2010/0034681 | A1* | 2/2010 | Fujita | F04C 2/3441 418/30 |
| 2011/0189043 | A1* | 8/2011 | Watanabe | F04C 15/06 418/133 |
| 2014/0377116 | A1 | 12/2014 | Watanabe et al. | |
| 2015/0078948 | A1 | 3/2015 | Yoshida et al. | |
| 2015/0267700 | A1 | 9/2015 | Fujita et al. | |
| 2016/0252080 | A1 | 9/2016 | Herkommer et al. | |

FOREIGN PATENT DOCUMENTS

| | | | |
|---|---|---|---|
| DE | 10233582 | B4 | 2/2004 |
| WO | WO 2015090311 | A1 | 6/2015 |

OTHER PUBLICATIONS

German Search Report DE102016201925.2, dated Dec. 7, 2016. (8 pages).

* cited by examiner

*Primary Examiner* — Theresa Trieu

(74) *Attorney, Agent, or Firm* — Dority & Manning, P.A.

(57) ABSTRACT

A vane cell pump for a transmission of a motor vehicle includes a housing. A rotor defines a plurality of slots. The plurality of slots runs radially. A plurality of vanes is arranged in the plurality of slots of the rotor. An end plate is positioned in a bottom area of the housing. The end plate is configured as a fluid guide with a suction channel and a pressure channel. The end plate forms a bottom wall of the housing.

7 Claims, 2 Drawing Sheets

VANE PUMP

FIELD OF THE INVENTION

The present invention relates generally to a vane cell pump, in particular for a transmission of a motor vehicle.

BACKGROUND

From the state of the art, with automatic transmissions, using hydraulic pumps (such as vane cell pumps) is known; hydraulic pumps make available the hydraulic pressure required for the operation of the transmission and the required conveying volume of the hydraulic control, by which the cooling and lubrication of the transmission and the actuation of the shifting elements of the transmission can be ensured.

In particular, with automatic transmissions of vehicles, using vane cell pumps, with which the vanes are arranged in slots of the rotor of the pump, is known; the vanes can move freely in the radial direction, are rotated along with the rotor and, through centrifugal force under rotational speed and through pressure oil, are applied, at the rear side of the vane (rear vane support), on the lifting ring of the pump or are pressed onto the inner contour of the lifting ring.

According to the state of the art, vane cell pumps for vehicle transmissions are designed as closed, pre-assembled units that can be tested separately; within the pump, the oil guide is primarily realized through an inserted end plate that is arranged in the bottom area of the vane cell pump. The oil guide features a suction channel and a pressure channel and is designed to be movable in an axial manner, whereas, based on the pressure difference between the two end faces of the end plate, the end plate is slightly pressed against the conveying elements of the pump, by which the axial gap of the pump is compensated for.

According to the state of the art, the end plate features a small thickness, since the pump bottom or housing bottom features a thickness that is not insignificant. This results in the suction channel being designed to be very steep, by which the oil flow is strongly deflected, which disadvantageously results in unfavorable flow conditions.

SUMMARY OF THE INVENTION

The present invention is subject to the task of providing a vane cell pump with which the suction channel is optimized with regard to flow conditions, without increasing the required installation space for the vane cell pump.

Accordingly, a vane cell pump, in particular for a transmission of a motor vehicle, is proposed, with a housing, including a rotor, into the circumferential surface of which slots are inserted, in which displaceable vanes are arranged, and an end plate that serves as the fluid guide and is arranged in the bottom area and features a suction channel and a pressure channel, for which the end plate forms the housing bottom in a manner that is neutral for installation space.

The design in accordance with example aspects of the invention and the absence of a separate housing bottom increase the thickness of the end plate, by which, in particular, the suction channel is designed to be less steep and is optimized in terms of flow, since the flow deflection is less strong. In this manner, the filling of the pump is optimized. Furthermore, by increasing the thickness of the end plate, the strength of the end plate is increased in an advantageous manner, by which undesirable deformations of the sealing surfaces are largely avoided.

Since the surface ratio of the two end faces of the end plate relative to each other remains unchanged, the axial gap compensation is maintained based on the pressure difference between the two end faces. The vane cell pump in accordance with example aspects of the invention is designed as a closed, pre-assembled unit, which can be tested separately.

BRIEF DESCRIPTION OF THE DRAWINGS

In the following, the invention is more specifically illustrated as an example on the basis of the attached figures. The following is shown.

DETAILED DESCRIPTION

Figure 1:
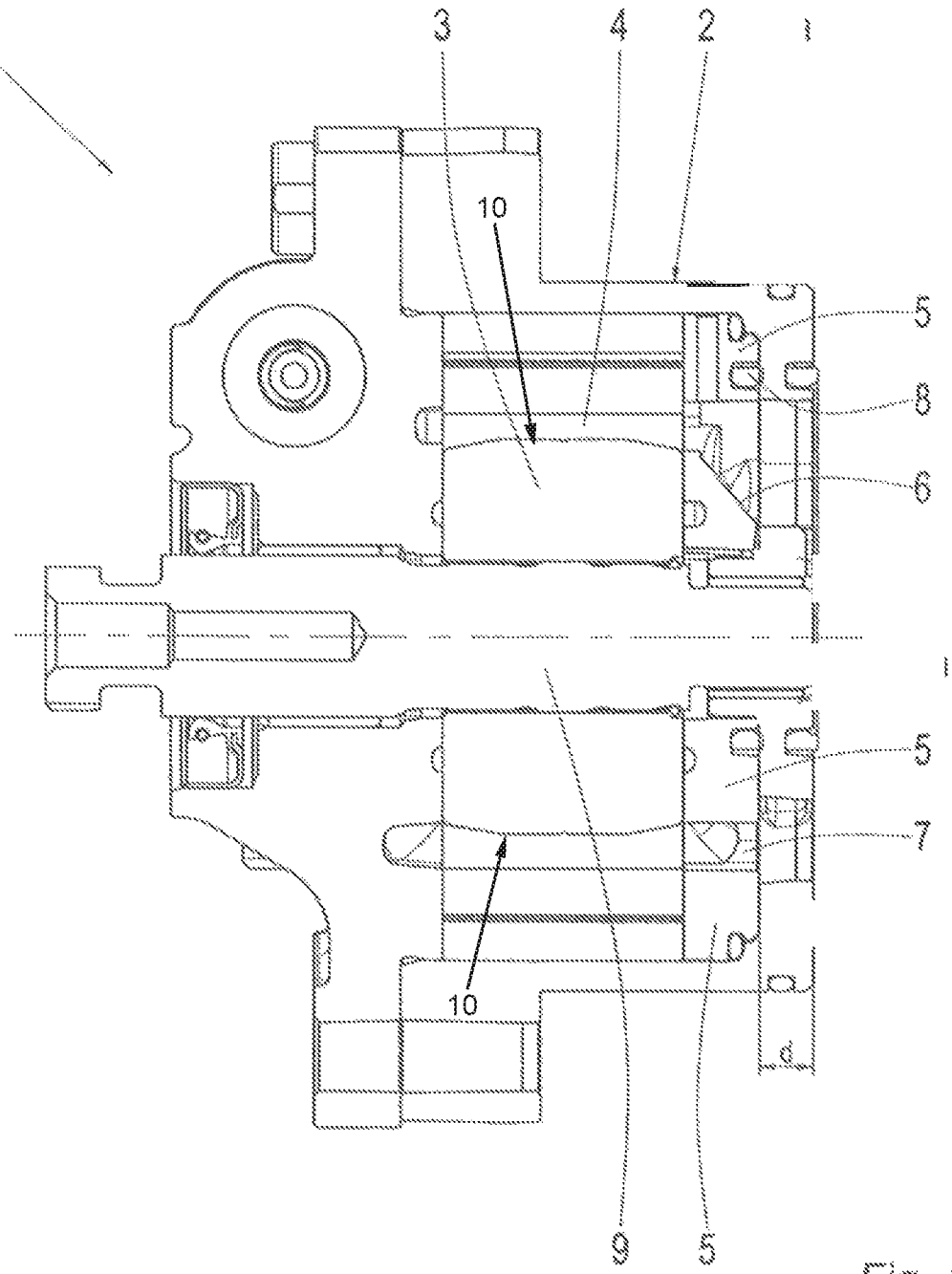
Fig. 1 Prior Art
FIG. 1: a schematic sectional view of a vane cell pump according to the state of the art.

Reference will now be made to embodiments of the invention, one or more examples of which are shown in the drawings. Each embodiment is provided by way of explanation of the invention, and not as a limitation of the invention. For example, features illustrated or described as part of one embodiment can be combined with another embodiment to yield still another embodiment. It is intended that the present invention include these and other modifications and variations to the embodiments described herein.

Vane cell pumps are well-known to the specialist, such that, within the framework of the following description of figures, only the components relevant to the invention are described and explained. Identical reference signs designate identical components.

In the attached FIG. 1, the reference sign 1 designates a vane cell pump according to the state of the art, whereas the housing of the pump, which also extends in the bottom area, is provided with the reference sign 2. The vane cell pump 1 includes a rotor 3, in the circumferential surface of which slots 10 that approximately run radially and extend across its width, in which displaceable vanes 4 are arranged. The vane cell pump 1 further includes an end plate 5 that serves as the fluid guide and is arranged in the bottom area, and features a suction channel 6 and a pressure channel 7. In order to seal the end plate 5 with respect to the housing 2, profile seals 8 are provided. The pump shaft is designated with 9.

With the vane cell pump according to FIG. 1, the end plate 5 features a small thickness, since the pump bottom or the housing bottom features a thickness d that is not insignificant. Consequently, the suction channel 6 is designed to be very steep, which leads to unfavorable flow conditions.

Figure 2:
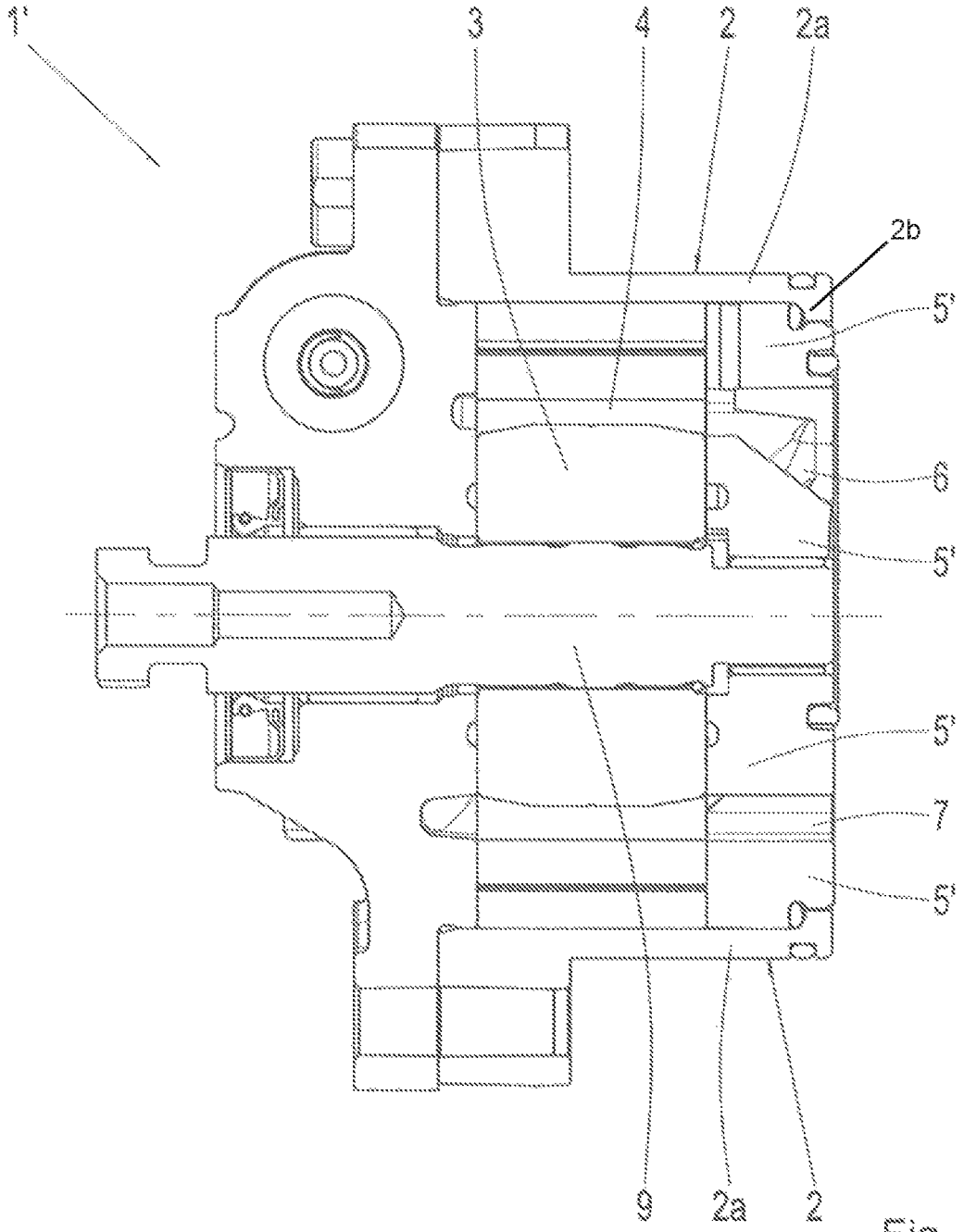
FIG. 2: a schematic sectional view of a vane cell pump in accordance with an example embodiment the invention.

In accordance with example aspects of the invention and with reference to FIG. 2, which presents a vane cell pump 1' designed in accordance with example aspects of the invention, the end plate 5' forms the housing bottom of the vane cell pump 1 in a manner that is neutral for installation space and while maintaining the dimensioning of the rotor and the additional components of the pump relative to vane cell pump 1 (FIG. 1). Due to the absence of a separate housing bottom, the end plate 5' features an increased thickness compared to the end plate 5 according to the state of the art, such that the suction channel 6 is designed to be less steep and is thus optimized in terms of flow. In addition, the stiffness of the end plate is increased compared to the end plate 5 according to the state of the art through the increased thickness of the end plate 5', by which any deformation of the sealing surfaces, in particular in the area of the suction channel 6, is avoided.

Furthermore, the profile seals 8 between the end plate 5 and the housing 2, as required according to the state of the art, are unnecessary.

The end plate 5' is held in a positive-locking manner by the inwardly bent ends 2*b* of the side walls 2*a* of the housing 2, such that the vane cell pump 1 is designed as a closed, pre-assembled unit, whereas the connection of the end plate 5' to the housing 2 is designed in such a manner that an axial gap compensation of the end plate 5 and a sliding bearing of the pump shaft 9 are achieved.

Modifications and variations can be made to the embodiments illustrated or described herein without departing from the scope and spirit of the invention as set forth in the appended claims.

REFERENCE SIGNS

1 Vane cell pump
1' Vane cell pump
2 Housing
3 Rotor
4 Vane
5 End plate
5' End plate
6 Suction channel
7 Pressure channel
8 Profile seals
9 Connection of the pump shafts

The invention claimed is:

1. A vane cell pump for a transmission of a motor vehicle, comprising:

a housing;

a rotor defining a plurality of slots, the plurality of slots running radially;

a plurality of vanes arranged in the plurality of slots of the rotor;

an end plate positioned in an open bottom area of the housing, the end plate configured as a fluid guide with a suction channel and a pressure channel, wherein the end plate is discrete from the housing, the end plate is positioned within the housing, and the end plate is attached to the housing such that the end plate forms a bottom wall of the housing, and wherein a side wall of the housing has an inwardly bent end that positively locks the end plate to the housing such that the vane cell pump is a closed, pre-assembled unit.

2. The vane cell pump of claim 1, wherein the housing does not have a separate housing bottom such that a thickness of the end plate is increased and the suction channel is optimized in terms of flow.

3. The vane cell pump of claim 1, wherein the transmission defines a vane cell pump installation space, the end plate forming the bottom wall of housing such that the vane cell pump is installation space neutral for the vane cell pump installation space of the transmission.

4. A vane cell pump for a transmission of a motor vehicle, comprising;

a housing;

a rotor positioned within the housing, the rotor defining a plurality of radially running slots;

a plurality of vanes mounted to the rotor, each vane of the plurality of vanes arranged in a respective one of the plurality of radially running slots of the rotor;

an end plate mounted to the housing such that the end plate extends from the rotor to an outer surface of the housing within the housing, the end plate defining a suction channel and a pressure channel, wherein the end plate is discrete from the housing, the end plate positioned within the housing, the end plate attached to the housing such that the end plate forms a bottom wall of the housing, the suction channel and the pressure channel extending from the rotor through the bottom wall of the housing, and wherein a side wall of the housing has an inwardly bent end that positively locks the end plate to the housing at an edge of the end plate such that the vane cell pump is a closed, pre-assembled unit.

5. The vane cell pump of claim 4, wherein the housing does not cover the end plate at a bottom area of the housing.

6. The vane cell pump of claim 4, wherein the vane cell pump does not include a profile seal that extends between the end plate and the housing at a bottom area of the housing.

7. The vane cell pump of claim 4, wherein a thickness of the end plate is increased by absence of a housing bottom at a bottom area of the housing such that the suction channel is optimized in terms of flow.

* * * * *